US007401719B2

(12) United States Patent
Ou

(10) Patent No.: US 7,401,719 B2
(45) Date of Patent: Jul. 22, 2008

(54) STAPLE-DRIVING GUN WITH SAFETY PROTECTION

(75) Inventor: Chen-Ho Ou, Taichung Hsien (TW)

(73) Assignee: Panrex Industrial Co., Ltd., Tai-Ping, Taichung Hsien (TW)

( * ) Notice: Subject to any disclaimer, the term of this patent is extended or adjusted under 35 U.S.C. 154(b) by 0 days.

(21) Appl. No.: 11/366,777

(22) Filed: Mar. 1, 2006

(65) Prior Publication Data

US 2008/0099527 A1 May 1, 2008

(51) Int. Cl.
*B25C 1/04* (2006.01)

(52) U.S. Cl. ..... 227/8; 227/107

(58) Field of Classification Search ..... 227/107, 227/8, 141, 119, 148, 147
See application file for complete search history.

(56) References Cited

U.S. PATENT DOCUMENTS 3,281,046 A * 10/1966 Boulay ..... 227/115
3,542,273 A * 11/1970 Hedrick ..... 227/130
4,907,730 A * 3/1990 Dion ..... 227/8
5,555,780 A * 9/1996 Beach et al. ..... 81/57.37
6,095,392 A * 8/2000 Batts et al. ..... 227/8
6,155,472 A * 12/2000 Deziel ..... 227/8
6,834,789 B1 * 12/2004 Dion et al. ..... 227/148

* cited by examiner

*Primary Examiner*—Brian D Nash
(74) *Attorney, Agent, or Firm*—DLA Piper US LLP

(57) ABSTRACT

A staple-driving gun includes a gun body having a hollow housing configured with first and second air chambers separated by a partition, and a staple-discharging member mounted on the housing. A piston unit includes an operating member connected fixedly to a sleeve disposed movably in the first air chamber, and a piston rod disposed movably in the sleeve. The operating member is operable so as to move a valve end portion of the sleeve away from the partition such that compressed air flowing from the first air chamber into the second air chamber via a valve hole in the partition urges the piston rod to move toward the staple-discharging member for staple discharging. A biasing member biases the sleeve to a standby position, where the valve end portion of the sleeve seals the valve hole in the partition.

3 Claims, 5 Drawing Sheets

STAPLE-DRIVING GUN WITH SAFETY PROTECTION

BACKGROUND OF THE INVENTION

1. Field of the Invention

The invention relates to a staple-driving gun, more particularly to a staple-driving gun with safety protection.

2. Description of the Related Art

Referring to FIG. 1, a conventional staple-driving gun is shown to include a gun body 1, a staple cartridge 3 and a piston unit 2.

The gun body 1 includes a handle 102, a staple-discharging member 103 formed with a staple-discharging hole 1032 that extends along an axis, and a hollow housing 101 connected fixedly to the handle 102 and having a first open end 1011, and a second open end 1012 opposite to the first open end 1011 along the axis and connected to the staple-discharging member 103. The housing 101 is configured with an inner surface that is divided into first and second air chambers 105, 106 by a partition 104 that is disposed fixedly in the housing 101 and that is formed with a valve hole 104'. The housing 101 is formed with an air inlet 109 in spatial communication with the first air chamber 105 for permitting compressed air to be fed into the first air chamber 105 therethrough.

The staple cartridge 3 is attached fixedly to the staple-discharging member 103, and is capable of receiving a row of staples (not shown) so as to feed the staples into the staple-discharging hole 1032 in the staple-discharging member 103 one at a time.

The piston unit 20 includes: a sleeve 201 disposed in the first air chamber 15, and having a coupling end portion 205 disposed movably in the first open end 1011 of the housing 101, and an enlarged valve end portion 207 disposed movably in the second air chamber 106 and having an outer diameter larger than a diameter of the valve hole 104' in the partition 104; an operating member 206 connected fixedly to the coupling end portion 205 of the sleeve 201, disposed outwardly of the housing 101, and movable along the axis; and a piston rod 202 disposed movably in the sleeve 202 and having a diameter-increased first piston end 2021 that is in slidable and sealing contact with the sleeve 201, and a second piston end 2022 opposite to the first piston end 2021 along the axis, extending outwardly of the sleeve 201, and disposed movably and sealingly in the second air chamber 106. The second piston end 2022 of the piston rod 202 has a fixed staple-striking piece 204 that extends along the axis into the staple-discharging hole 1032 in the staple-discharging member 103.

The operating member 206 is operable so as to move the sleeve 201 from a standby position, where the valve end portion 207 of the sleeve 201 is in sealing contact with the partition 104 so as to seal the valve hole 104' in the partition 104 such that flow of the compressed air from the first air chamber 105 into the second air chamber 106 through the valve hole 104' in the partition 104 is prevented, as shown in FIG. 1, to a staple-discharging position, where the valve end portion 207 of the sleeve 201 is separated from the partition 104 so as to allow for flow of the compressed air from the first air chamber 105 into the second air chamber 106 through the valve hole 104' in the partition 104 such that the compressed air flowing from the first air chamber 105 into the second air chamber 106 via the valve hole 104' in the partition 104 urges the second piston end 2022 of the piston rod 202 to move toward the second open end 1012 of the housing 101, thereby discharging one of the staples in the staple-discharging hole 1032 in the staple-discharging member 103 in response to one strike of the staple-striking piece 204 thereon, as shown in FIG. 2.

However, if the operating member 206 is moved to the staple-discharging position due to an unintentional operation while the conventional staple-driving gun is in an unused state, i.e., the compressed air is not applied, as shown in FIG. 3, once the compressed air is applied to the conventional staple-driving gun, the undesired staple-discharging operation is performed, thereby resulting in danger during use.

SUMMARY OF THE INVENTION

Therefore, the object of the present invention is to provide a staple-driving gun with safety protection.

According to the present invention, a staple-driving gun comprises:

a gun body including a handle, a hollow housing connected fixedly to the handle, and having first and second open ends opposite to each other along an axis, the housing being configured with an inner space and further having a partition disposed fixedly in the inner space so as to divide the inner space into a first air chamber disposed adjacent to the first open end, and a second air chamber disposed adjacent to the second open end, the partition being formed with a valve hole, the axis extending through the valve hole in the partition, the housing being formed with an air inlet in spatial communication with the first air chamber for permitting compressed air to be fed into the first air chamber therethrough, and a staple-discharging member mounted on the second open end of the housing and formed with a staple-discharging hole that extends along the axis;

a staple cartridge attached fixedly to the staple-discharging member, and adapted to receive a row of staples so as to feed the staples into the staple-discharging hole in the staple-discharging member one at a time;

a piston unit including a sleeve disposed in the first air chamber, movable along the axis, and having a coupling end portion disposed movably in the first open end of the housing, and an enlarged valve end portion disposed movably in the second air chamber and having an outer diameter larger than a diameter of the valve hole in the partition, an operating member connected fixedly to the coupling end portion of the sleeve, disposed outwardly of the housing, and movable along the axis, and a hollow piston rod disposed movably in the sleeve and having a diameter-increased first piston end that is in slidable and sealing contact with the sleeve, a second piston end that is opposite to the first piston end along the axis, that extends outwardly of the sleeve, and that is disposed movably and sealingly in the second air chamber, and an intermediate rod portion disposed between and interconnecting the first and second piston ends, the second piston end of the piston rod having a fixed staple-striking piece that extends along the axis into the staple-discharging hole in the staple-discharging member, the operating member being operable so as to move the sleeve from a standby position, where the valve end portion of the sleeve is in sealing contact with the partition so as to seal the valve hole in the partition such that flow of the compressed air from the first air chamber into the second air chamber through the valve hole in the partition is prevented, to a staple-discharging position, where the valve end portion of the sleeve is separated from the partition so as to allow for flow of the compressed air from the first air chamber into the second air chamber through the valve hole in the partition such that the compressed air flowing from the first air chamber into the second air chamber via the valve hole in the partition urges the second piston end of the piston rod to move toward the second open end of the housing, thereby discharging one of the staples in the staple-discharging hole in the staple-discharging member in response to one strike of the staple-striking piece thereon; and a biasing member for biasing the sleeve to the standby position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
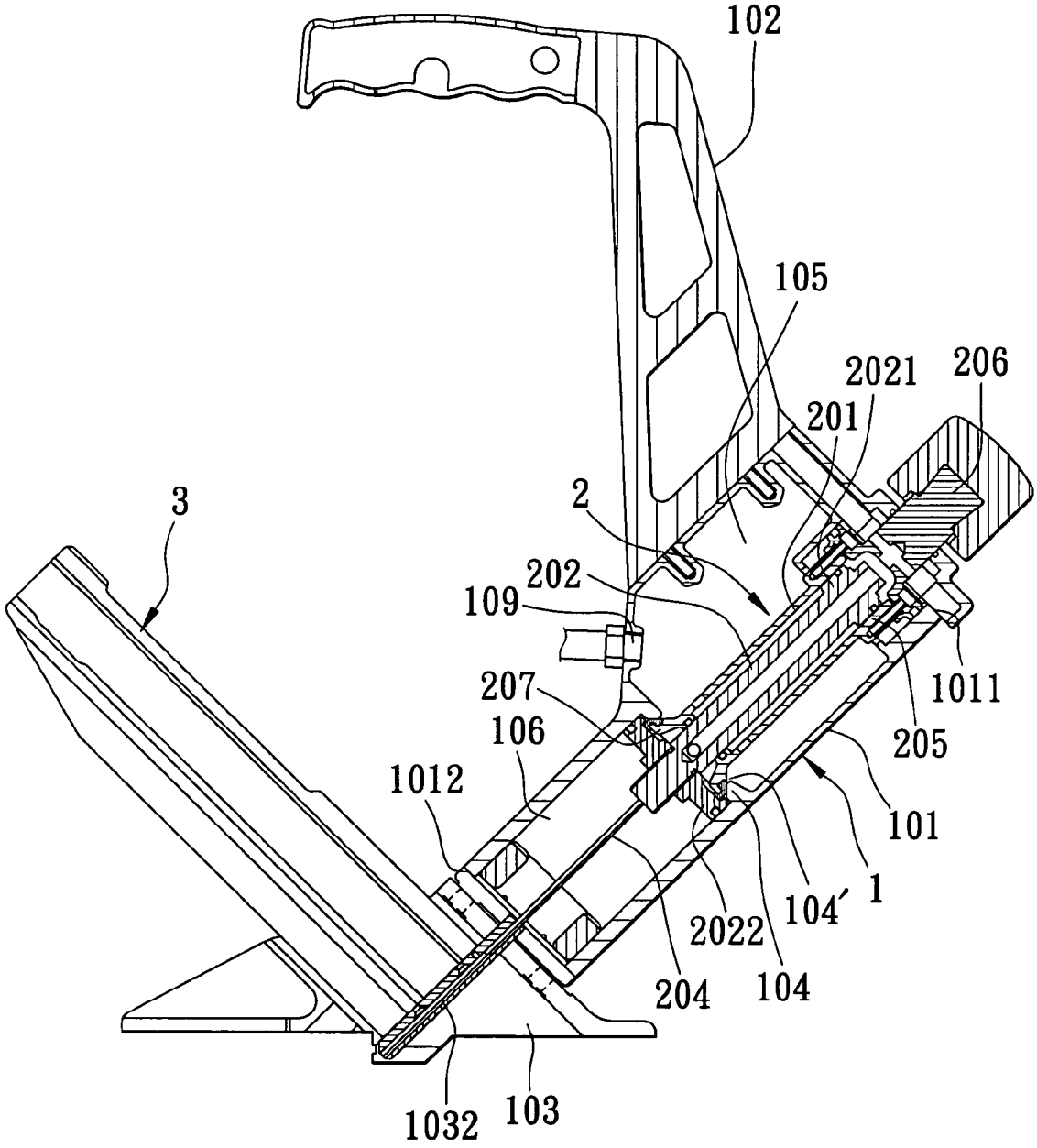
FIG. 1 PRIOR ART
FIG. 1 is a schematic sectional view of a conventional staple-driving gun.
Figure 2:
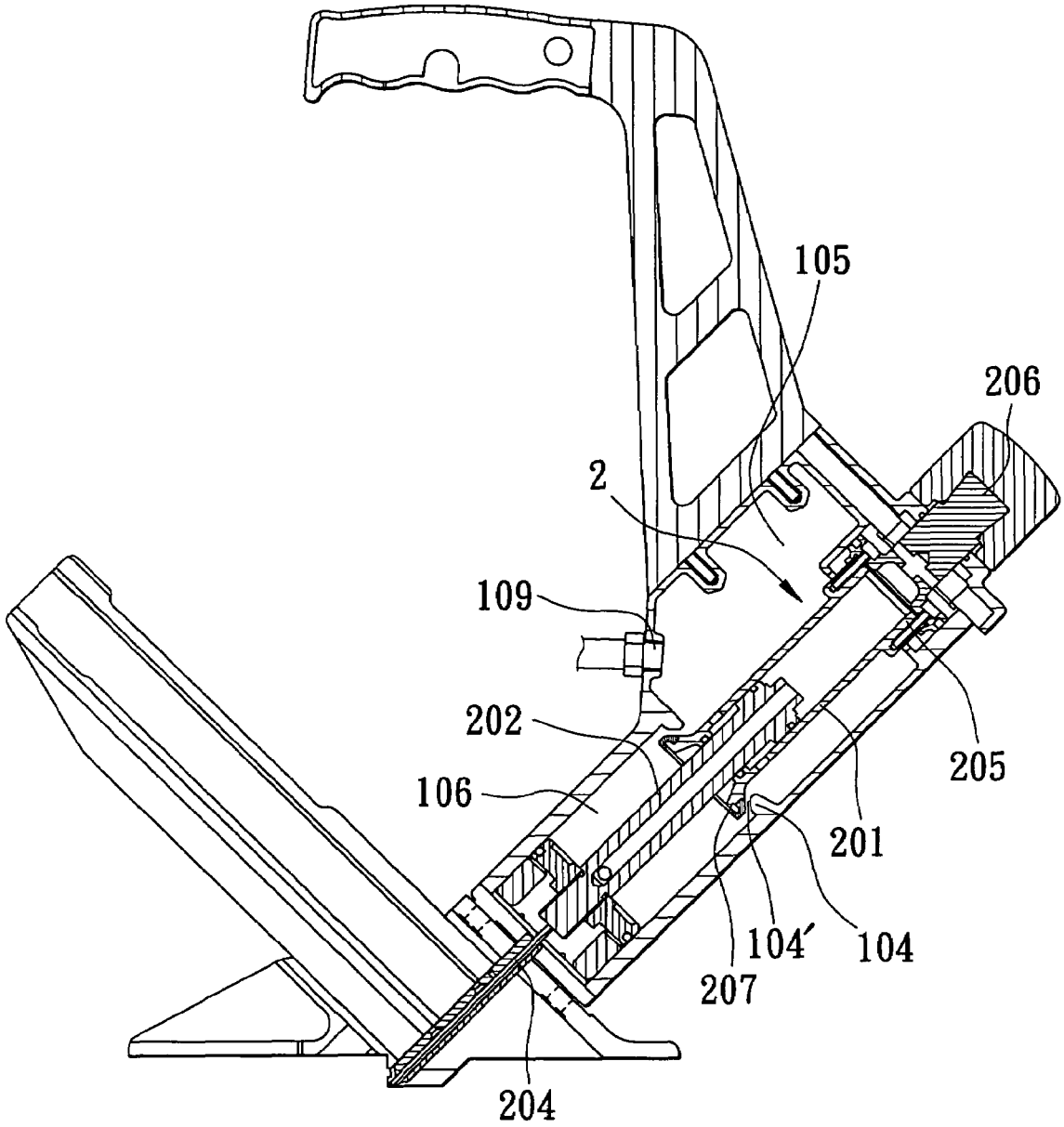
FIG. 2 PRIOR ART
FIG. 2 is a schematic sectional view of the conventional staple-driving gun when a sleeve is moved to a staple-discharging position by a normal operation of an operating member.
Figure 3:
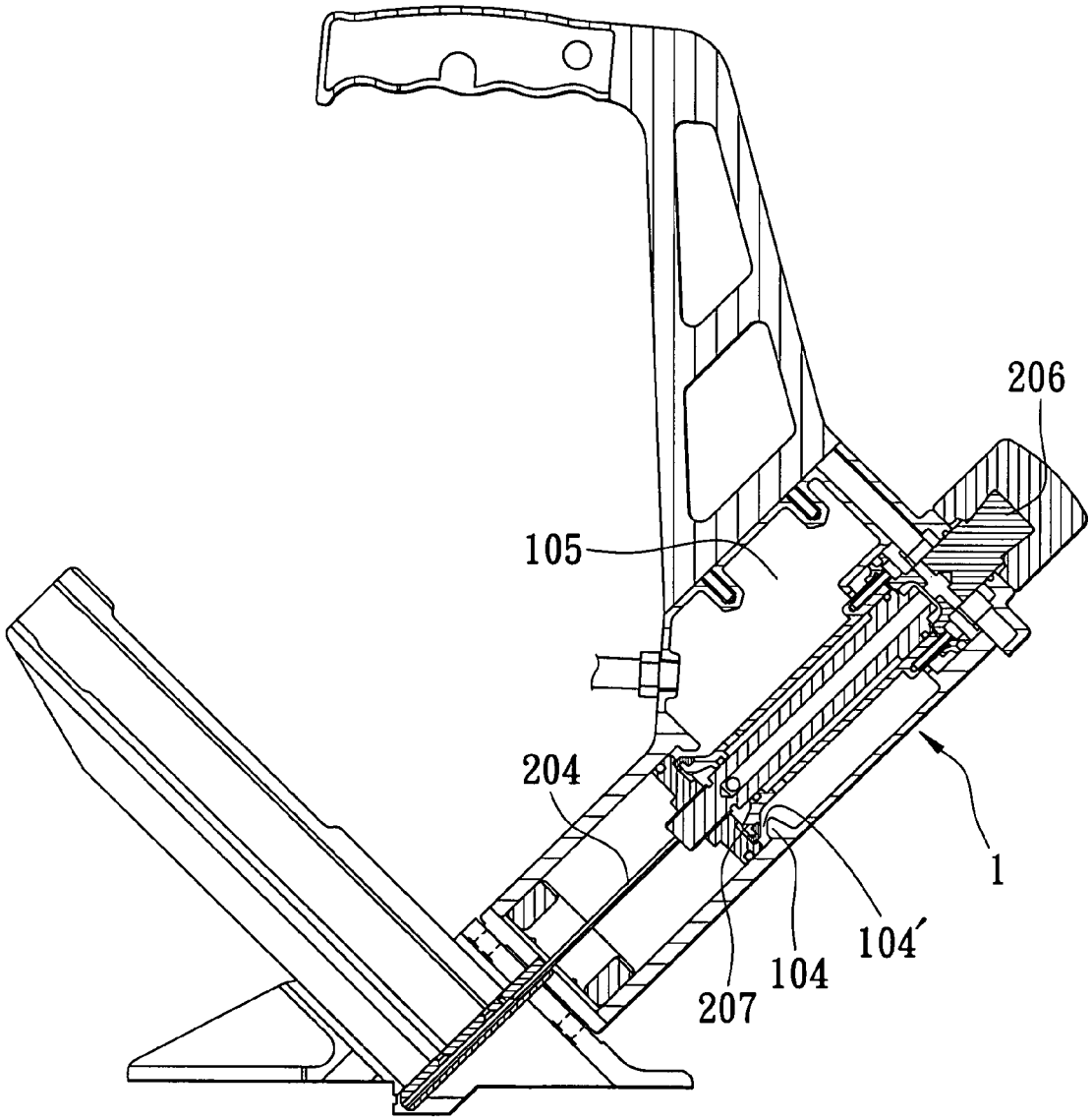
FIG. 3 PRIOR ART
FIG. 3 is a schematic sectional view of the conventional staple-driving gun when a sleeve is moved to the staple-discharging position by an unintentional operation of the operating member.
Figure 4:
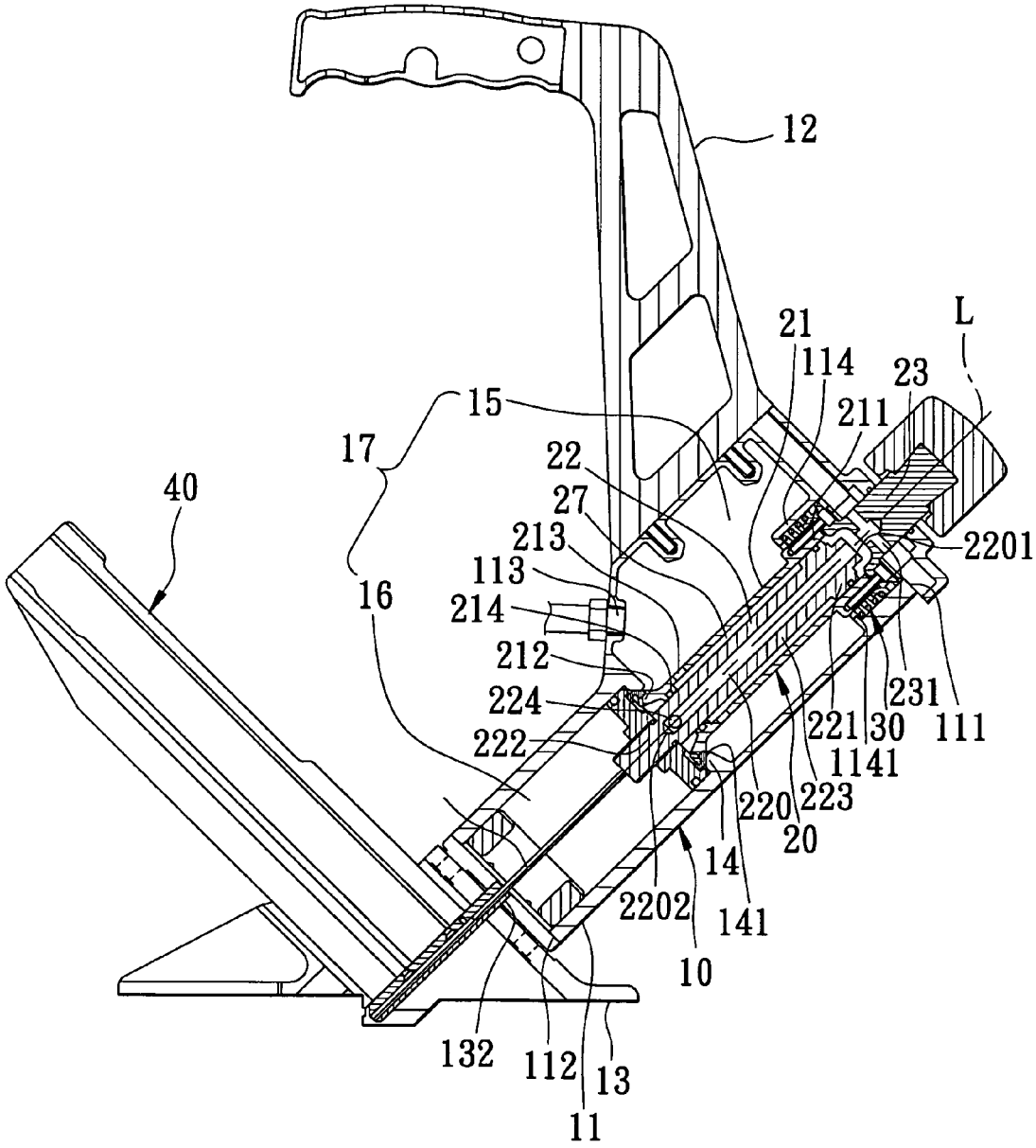
FIG. 4 is a schematic sectional view showing the preferred embodiment of a staple-driving gun according to the present invention.

Referring to FIG. 4, the preferred embodiment of a staple-driving gun according to the present invention is shown to include a gun body 10, a staple cartridge 40, a piston unit 20, and a biasing member 30.

The gun body 10 includes a handle 12, a hollow housing 11, and a staple-discharging member 13.

The housing 11 is connected fixedly to the handle 12, and has first and second open ends 111, 112 opposite to each other along an axis (L). The housing 11 is configured with an inner space 17, and has a partition 14 disposed fixedly in the inner space 17 and perpendicular to the axis (L) so as to divide the inner space 17 into a first air chamber 15 disposed adjacent to the first open end 111, and a second air chamber 16 disposed adjacent to the second open end 112. The partition 14 is formed with a valve hole 141. The axis (L) extends through the valve hole 141 in the partition 14. The housing 11 is formed with an air inlet 113 in spatial communication with the first air chamber 15 for permitting compressed air to be fed into the first air chamber 15 therethrough. In this embodiment, the first open end 111 of the housing 11 has an integral annular inner wall 114 extending toward the second open end 112 of the housing 11 along the axis (L) and having a radially and inwardly extending annular stop flange 1141.

The staple-discharging member 13 is mounted on the second open end 112 of the housing 11, and is formed with a staple-discharging hole 132 that extends along the axis (L).

The staple cartridge 40 is attached fixedly to the staple-discharging member 13, and is adapted to receive a row of staples (not shown) so as to feed the staples into the staple-discharging hole 132 in the staple-discharging member 13 one at a time.

The piston unit 20 includes a sleeve 21, an operating member 23, and a hollow piston rod 22.

The sleeve 21 is disposed in the first air chamber 15, is movable along the axis (L), and has a coupling end portion 211 disposed movably in the first open end 111 of the housing 11 and surrounded by the annular inner wall 114, and an enlarged valve end portion 212 disposed movably in the second air chamber 16 and having an outer diameter larger than a diameter of the valve hole 141 in the partition 14. In this embodiment, the sleeve 21 is formed with a plurality of air guiding holes 213 disposed adjacent to the valve end portion 212. The sleeve 21 further has a radially and inwardly extending integral inward flange 214 that is disposed between the valve end portion 212 and the air guiding holes 213.

The operating member 23 is connected fixedly to the coupling end portion 211 of the sleeve 21, is disposed outwardly of the housing 11, and is movable along the axis (L). In this embodiment, the operating member 23 is formed with an air outlet 231.

The piston rod 22 is disposed movably in the sleeve 21, and has a diameter-increased first piston end 221, a second piston end 222, and an intermediate rod portion 223. The first piston end 221 of the piston rod 22 is in slidable and sealing contact with the sleeve 21. The second piston end 222 of the piston rod 22 is opposite to the first piston end 221 along the axis (L), extends outwardly of the sleeve 21, and is disposed movably and sealingly in the second air chamber 16. The intermediate rod portion 223 of the piston rod 22 is disposed between and interconnects the first and second piston ends 221, 222, and is in slidable and sealing contact with the inward flange 214 of the sleeve 21. The second piston end 222 of the piston rod 22 has a fixed staple-striking piece 24 that extends along the axis (L) into the staple-discharging hole 132 in the staple-discharging member 13. In this embodiment, the sleeve 21 cooperates with the piston rod 22 to define a volume-changeable annular third air chamber 27 among the inward flange 214 of the sleeve 21, and the first piston end 221 and the intermediate rod portion 223 of the piston rod 22. The air guiding holes 213 in the sleeve 21 are in spatial communication with the first and third air chambers 15, 27. In this embodiment, the piston rod 22 defines an inner axial hole 220, and is formed with a through hole 224 disposed adjacent to the second piston end 222 and in spatial communication with the inner axial hole 220. The inner axial hole 220 has an open end 2201 formed in the first piston end 221 of the piston rod 22, and a closed end 2202 disposed adjacent to the second piston end 222 of the piston rod 22. The through hole 224 and the inner axial hole 220 in the piston rod 22 cooperate with the air outlet 231 in the operating member 23 to constitute an air discharging passage.

In this embodiment, the biasing member 30 is a coiled compression spring that is disposed between the coupling end portion 211 of the sleeve 21 and the annular inner wall 114 of the housing 11 and between the operating member 23 of the piston unit 20 and the annular stop flange 1141 of the annular inner wall 114 of the housing 11.

Figure 5:
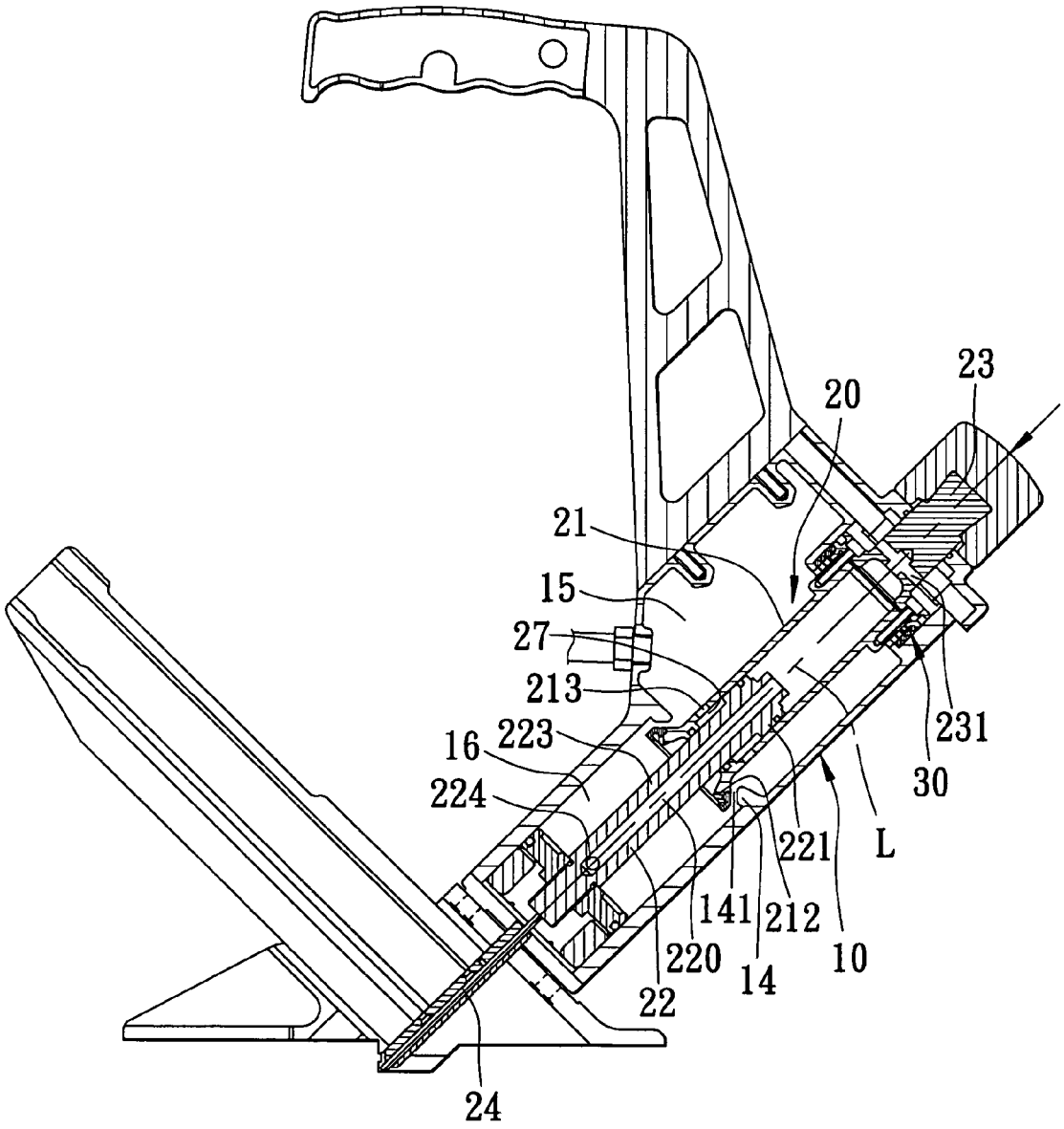
FIG. 5 is a schematic sectional view showing the preferred embodiment when a sleeve is moved to a staple-discharging position.

In use, the operating member 23 of the piston unit 20 is operable so as to move the sleeve 21 from a standby position, where the valve end portion 212 of the sleeve 21 in sealing contact with the partition 14 so as to seal the valve hole 141 in the partition 14 such that flow of the compressed air from the first air chamber 15 into the second air chamber 16 through the valve hole 141 in the partition 14 is prevented, as shown in FIG. 4, to a staple-discharging position, where the valve end portion 212 of the sleeve 21 is separated from the partition 14 so as to allow for flow of the compressed air from the first air chamber 15 into the second air chamber 16 through the valve hole 141 in the partition 14 such that the compressed air flowing from the first air chamber 15 into the second air chamber 16 via the valve hole 141 in the partition 14 urges the second piston end 222 of the piston rod 22 of the piston unit 20 to move toward the second open end 112 of the housing 11, thereby discharging one of the staples in the staple-discharging hole 132 in the staple-discharging member 13 in response to one strike of the staple-striking piece 24 thereon, as shown in FIG. 5. Thereafter, the biasing member 30 biases the sleeve 21 to the standby position. The compressed air in the second air chamber 16 is discharged to the outside via the air-discharging passage, and simultaneously, the compressed air flowing from the first air chamber 15 into the third air chamber 27 via the air guiding holes 213 in the sleeve 21 urges the first piston end 221 of the piston rod 22 toward the first open end 111 of the housing 11.

It is noted that, due to the presence of the biasing member 30 for biasing the sleeve 21 to the standby position, the unintentional operation of the operating member 23 occurring in the aforesaid conventional staple-driving gun can be prevented, thereby ensuring safety during use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A staple-driving gun comprising:

a gun body including a handle, a hollow housing connected fixedly to said handle, and having first and second open ends opposite to each other along an axis, said housing being configured with an inner space and further having a partition disposed fixedly in said inner space so as to divide said inner space into a first air chamber disposed adjacent to said first open end, and a second air chamber disposed adjacent to said second open end, said partition being formed with a valve hole, the axis extending through said valve hole in said partition, said housing being formed with an air inlet in spatial communication with said first air chamber for permitting compressed air to be fed into said first air chamber therethrough, and a staple-discharging member mounted on said second open end of said housing and formed with a staple-discharging hole that extends along the axis;

a staple cartridge attached fixedly to said staple-discharging member, and adapted to receive a row of staples so as to feed the staples into said staple-discharging hole in said staple-discharging member one at a time;

a piston unit including a sleeve disposed in said first air chamber, movable along the axis, and having a coupling end portion disposed movably in said first open end of said housing, and an enlarged valve end portion disposed movably in said second air chamber and having an outer diameter larger than a diameter of said valve hole in said partition, an operating member connected fixedly to said coupling end portion of said sleeve, disposed outwardly of said housing, and movable along the axis, and a hollow piston rod disposed movably in said sleeve and having a diameter-increased first piston end that is in slidable and sealing contact with said sleeve, a second piston end that is opposite to said first piston end along the axis, that extends outwardly of said sleeve, and that is disposed movably and sealingly in said second air chamber, and an intermediate rod portion disposed between and interconnecting said first and second piston ends, said second piston end of said piston rod having a fixed staple-striking piece that extends along the axis into said staple-discharging hole in said staple-discharging member, said operating member being operable so as to move said sleeve from a standby position, where said valve end portion of said sleeve is in sealing contact with said partition so as to seal said valve hole in said partition such that flow of the compressed air from said first air chamber into said second air chamber through said valve hole in said partition is prevented, to a staple-discharging position, where said valve end portion of said sleeve is separated from said partition so as to allow for flow of the compressed air from said first air chamber into said second air chamber through said valve hole in said partition such that the compressed air flowing from said first air chamber into said second air chamber via said valve hole in said partition urges said second piston end of said piston rod to move toward said second open end of said housing, thereby discharging one of the staples in said staple-discharging hole in said staple-discharging member in response to one strike of said staple-striking piece thereon;

a biasing member for biasing said sleeve to the standby position; and wherein said first open end of said housing has an integral annular inner wall extending toward said second open end of said housing along the axis, surrounding said coupling end portion of said sleeve, and having a radially and inwardly extending annular stop flange, said biasing member being disposed between said coupling end portion of said sleeve and said annular inner wall of said housing and between said operating member of said piston unit and said annular stop flange of said annular inner wall of said housing.

2. The staple-driving gun as claimed in claim 1, wherein said biasing member is a coiled compression spring.

3. A staple-driving gun comprising:

a gun body including a handle, a hollow housing connected fixedly to said handle, and having first and second open ends opposite to each other along an axis, said housing being configured with an inner space and further having a partition disposed fixedly in said inner space so as to divide said inner space into a first air chamber disposed adjacent to said first open end, and a second air chamber disposed adjacent to said second open end, said partition being formed with a valve hole, the axis extending through said valve hole in said partition, said housing being formed with an air inlet in spatial communication with said first air chamber for permitting compressed air to be fed into said first air chamber therethrough, and a staple-discharging member mounted on said second open end of said housing and formed with a staple-discharging hole that extends along the axis;

a staple cartridge attached fixedly to said staple-discharging member, and adapted to receive a row of staples so as to feed the staples into said staple-discharging hole in said staple-discharging member one at a time;

a piston unit including a sleeve disposed in said first air chamber, movable along the axis, and having a coupling end portion disposed movably in said first open end of said housing, and an enlarged valve end portion disposed movably in said second air chamber and having an outer diameter larger than a diameter of said valve hole in said partition, an operating member connected fixedly to said coupling end portion of said sleeve, disposed outwardly of said housing, and movable along the axis, and a hollow piston rod disposed movably in said sleeve and having a diameter-increased first piston end that is in slidable and sealing contact with said sleeve, a second piston end that is opposite to said first piston end along the axis, that extends outwardly of said sleeve, and that is disposed movably and sealingly in said second air chamber, and an intermediate rod portion disposed between and interconnecting said first and second piston ends, said second piston end of said piston rod having a fixed staple-striking piece that extends along the axis into said staple-discharging hole in said staple-discharging member, said operating member being operable so as to move said sleeve from a standby position, where said valve end portion of said sleeve is in sealing contact with said partition so as to seal said valve hole in said partition such that flow of the compressed air from said first air chamber into said second air chamber through said valve hole in said partition is prevented, to a staple-discharging position, where said valve end portion of said sleeve is separated from said partition so as to allow for flow of the compressed air from said first air chamber into said second air chamber through said valve hole in said partition such that the compressed air flowing from said first air chamber into said second air chamber via said valve hole in said partition urges said second piston end of said piston rod to move toward said second open end of said housing, thereby discharging one of the staples in said staple-discharging hole in said staple-discharging member in response to one strike of said staple-striking piece thereon;

a biasing member for biasing said sleeve to the standby position; and wherein said sleeve cooperates with said piston rod to define a volume-changeable annular third air chamber among said sleeve, and said first piston end and said intermediate rod portion of said piston rod, said sleeve being formed with an air guiding hole in spatial communication with said first and third air chambers so that the compressed air flows from said first air chamber into said third air chamber so as to move said first piston end of said piston rod toward said first open end of said housing when discharge of said one of the staples is completed, said piston rod defining an inner axial hole and being formed with a through hole in spatial communication with said inner axial hole, said inner axial hole having an open end formed in said first piston end of said piston rod, and a closed end disposed adjacent to said second piston end of said piston rod, said operating member being formed with an air outlet in spatial communication with said inner axial hole in said piston rod and cooperating with said through hole and said inner axial hole in said piston rod to constitute an air discharging passage.

* * * * *